US009334622B2

(12) United States Patent
Pusheck

(10) Patent No.: US 9,334,622 B2
(45) Date of Patent: May 10, 2016

(54) CONDUIT SUPPORT SYSTEM

(71) Applicant: Harnischfeger Technologies, Inc., Wilmington, DE (US)

(72) Inventor: Bernard Pusheck, Cudahy, WI (US)

(73) Assignee: Harnischfeger Technologies, Inc., Wilmington, DE (US)

( * ) Notice: Subject to any disclaimer, the term of this patent is extended or adjusted under 35 U.S.C. 154(b) by 42 days.

(21) Appl. No.: 14/057,085

(22) Filed: Oct. 18, 2013

(65) Prior Publication Data

US 2014/0112749 A1 Apr. 24, 2014

Related U.S. Application Data

(60) Provisional application No. 61/716,090, filed on Oct. 19, 2012, provisional application No. 61/778,832, filed on Mar. 13, 2013.

(51) Int. Cl.
*E02F 3/30* (2006.01)
*E02F 3/46* (2006.01)
*E02F 9/22* (2006.01)

(52) U.S. Cl.
CPC . *E02F 3/304* (2013.01); *E02F 3/46* (2013.01); *E02F 9/2275* (2013.01)

(58) Field of Classification Search
CPC ..... E02F 3/3654; E02F 3/3663; E02F 3/46; E02F 3/2275; E02F 3/43
USPC ..... 414/685, 690; 248/68.1
See application file for complete search history.

(56) References Cited

U.S. PATENT DOCUMENTS

| | | | | |
|---|---|---|---|---|
| 1,410,201 | A * | 3/1922 | Lutz | E02F 3/4075 414/692 |
| 3,219,213 | A | 11/1965 | Learmont | |
| 4,156,436 | A * | 5/1979 | Hawk | E02F 9/2275 137/355.17 |
| 4,273,066 | A * | 6/1981 | Anderson | 114/256 |
| 4,276,918 | A * | 7/1981 | Sigouin | A01G 23/095 144/24.13 |
| 4,958,981 | A | 9/1990 | Uchihashi | |
| 5,820,074 | A | 10/1998 | Trommer et al. | |
| 6,718,663 | B1 | 4/2004 | Geraghty | |
| 7,153,082 | B2 * | 12/2006 | Nolasco | 414/563 |
| 7,877,906 | B2 | 2/2011 | Ramun | |
| 7,950,171 | B2 | 5/2011 | Wurster | |
| 7,984,575 | B2 | 7/2011 | Robl et al. | |
| 8,032,313 | B2 * | 10/2011 | Claxton | E02F 3/30 702/42 |
| 2007/0039860 | A1 * | 2/2007 | Krock et al. | 210/170.01 |
| 2014/0099179 | A1 * | 4/2014 | Jones | 414/685 |

* cited by examiner

*Primary Examiner* — Ernesto Suarez
*Assistant Examiner* — Ronald Jarrett
(74) *Attorney, Agent, or Firm* — Michael Best & Friedrich LLP

(57) ABSTRACT

An industrial machine includes a frame supporting a boom having a first end and a second end opposite the first end, an arm movably coupled to the boom and including a first end and a second end, an attachment coupled to the first end of the arm, a conduit extending from the frame to a position adjacent the attachment, a first member coupled to the boom, and a second member spaced apart from the first member. The first member supports a portion of the conduit as the arm moves relative to the boom. The second member supports a portion of the conduit as the arm moves relative to the boom. The second member is movable relative to the first member.

27 Claims, 11 Drawing Sheets

CONDUIT SUPPORT SYSTEM

CROSS REFERENCE TO RELATED APPLICATIONS

This application claims the benefit of and priority to U.S. Provisional Patent Application No. 61/716,090, filed Oct. 19, 2012, and U.S. Provisional Patent Application No. 61/778,832, filed Mar. 13, 2013, and the entire contents of both of which are incorporated by reference herein.

BACKGROUND

The present invention relates to industrial machines. Specifically, the present invention relates to a fluid conveyance system for an earthmoving machine attachment.

Conventional rope shovels include a frame supporting a boom and a handle coupled to the boom for rotational and translational movement. A dipper is attached to the handle and is supported by a cable or rope that passes over an end of the boom. The rope is secured to a bail that is pivotably coupled to the dipper. During the hoist phase, the rope is reeled in by a hoist drum, lifting the dipper upward through a bank of material and liberating a portion of the material. The orientation of the dipper relative to the handle is generally fixed and cannot be controlled independently of the handle and the hoist rope.

SUMMARY

In one aspect, the invention provides an industrial machine including a frame supporting a boom having a first end and a second end opposite the first end, an arm movably coupled to the boom and including a first end and a second end, an attachment coupled to the first end of the arm, a conduit extending from the frame to a position adjacent the attachment, a first member coupled to the boom, and a second member spaced apart from the first member. The first member supports a portion of the conduit as the arm moves relative to the boom. The second member supports a portion of the conduit as the arm moves relative to the boom. The second member is movable relative to the first member.

In another aspect the invention provides a conduit support system for an industrial machine. The industrial machine has a frame supporting a boom including a saddle block, an arm having a first end and a second end and supported by the saddle block for movement relative to the boom, and an attachment coupled to the second end of the arm. The conduit support system includes a conduit for providing communication between the frame and the second end of the arm, a first member supporting a first portion of the conduit, and a second member spaced apart from the first member. The second member is movable relative to the first member due to movement of the arm relative to the boom. The second member supports a second portion of the conduit.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

Figure 1:
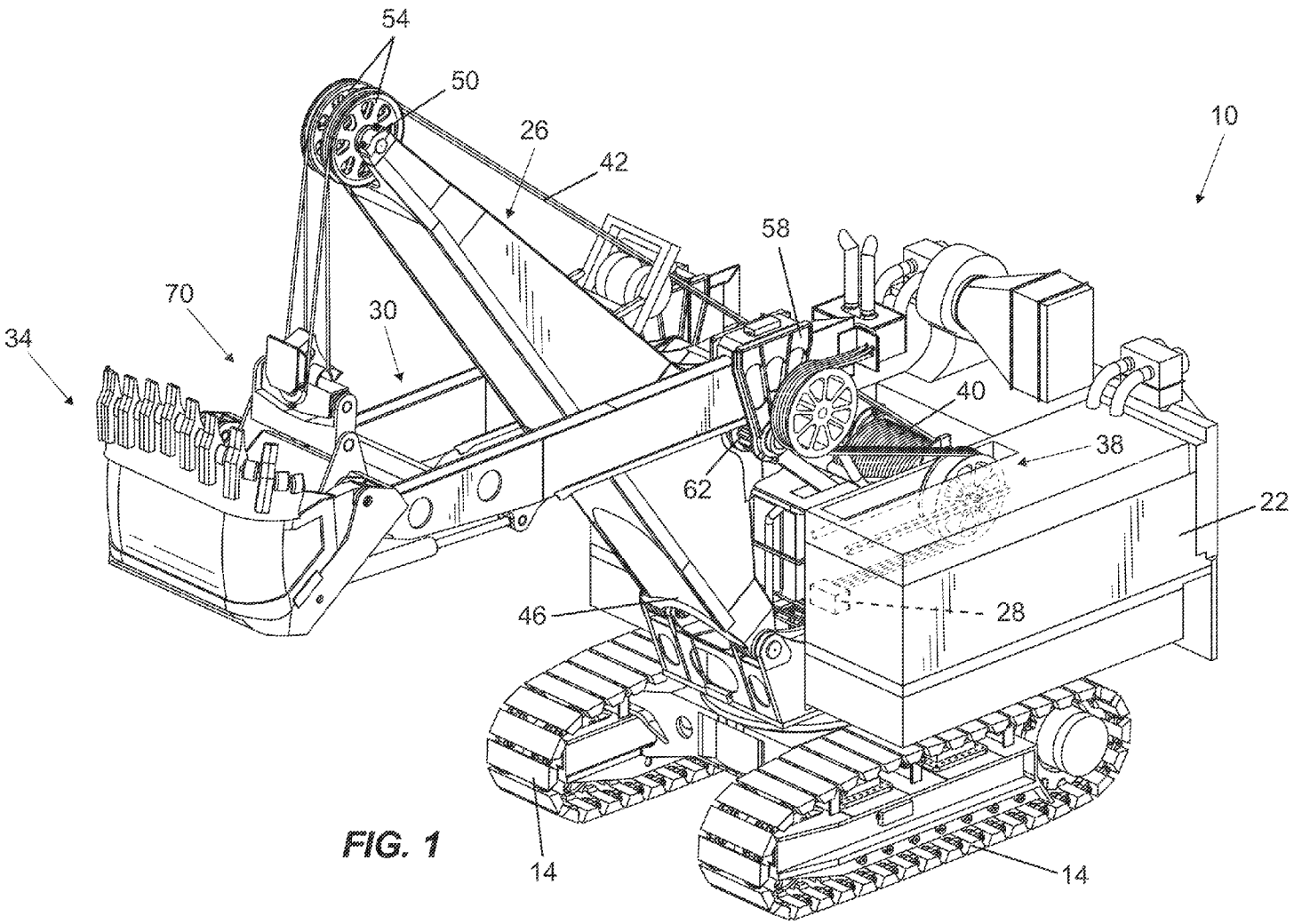
FIG. 1 is a perspective view of a mining machine according to one embodiment of the invention.

FIG. 1 shows an industrial machine, such as a mining shovel 10, supported by tracks 14 on a support surface or ground (not shown). The shovel 10 includes a frame 22 supporting a boom 26 and a fluid source 28 (e.g., a fluid pump or tank), an elongated member or handle 30, an attachment or bucket 34 including pivot actuators 36 (FIG. 2), and a conduit support system 38. The frame 22 includes a rotational structure for rotating about an axis of rotation (not shown) that is generally perpendicular to a plane corresponding to a grade of the support surface. The frame 22 also includes a hoist drum 40 for reeling in and paying out a cable or rope 42. Although the conduit support system 38 is described with respect to the mining shovel 10, the support system 38 may be used on other machines, including other mining machines.

Figure 2:
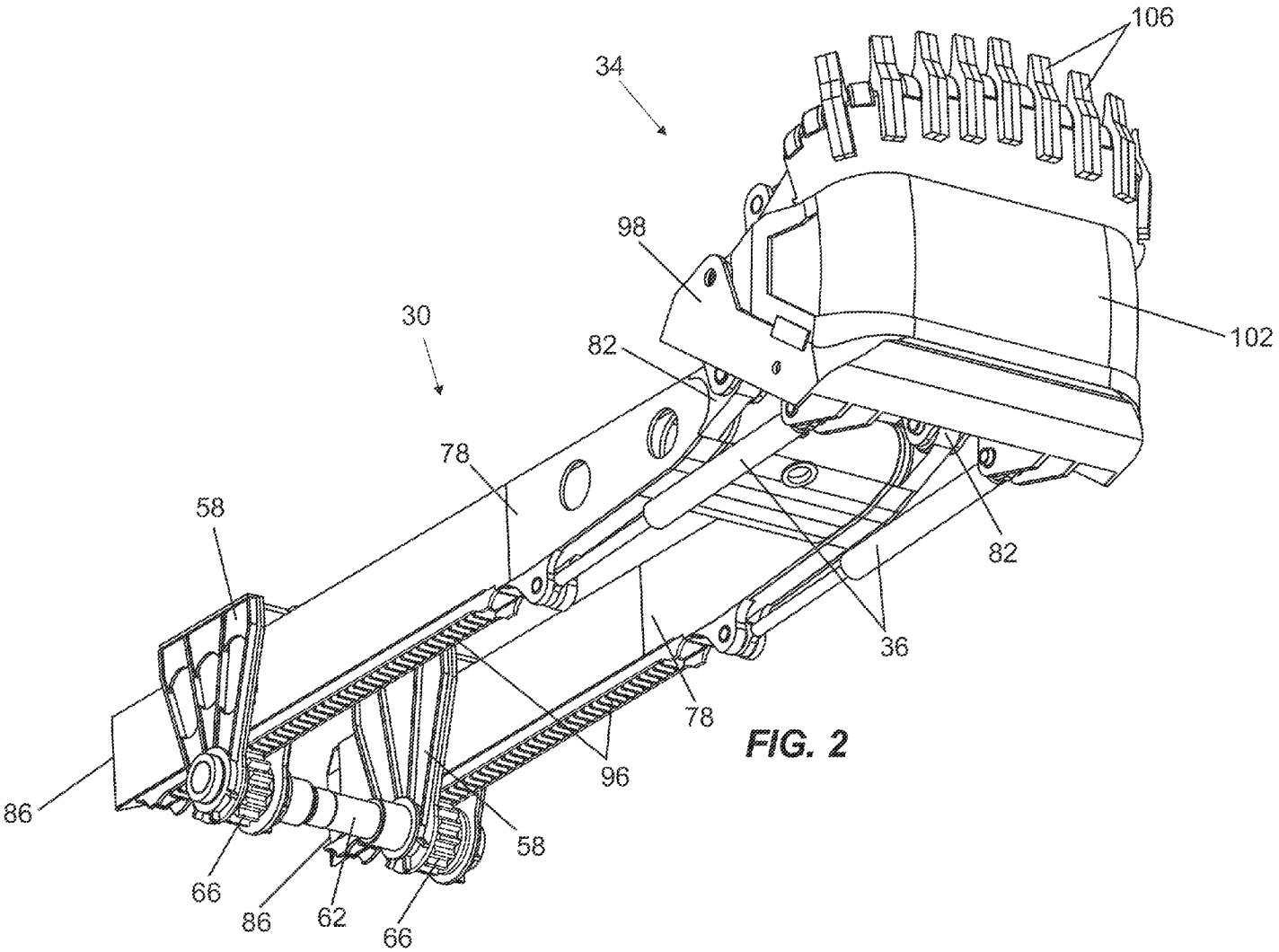
FIG. 2 is a perspective view of a handle, a saddle block, a shipper shaft, and a bucket.

The boom 26 includes a first end 46 coupled to the frame 22, a second end 50 opposite the first end 46, a boom sheave 54, saddle blocks 58, and a shipper shaft 62. The boom sheave 54 is coupled to the second end 50 of the boom 26 and guides the rope 42 over the second end 50. The rope 42 is coupled to the bucket 34 by a bail 70, and the bucket 34 is raised or lowered as the rope 42 is reeled in or paid out, respectively, by the hoist drum 40. The shipper shaft 62 extends through the boom 26 and is positioned between the first end 46 and the second end 50 of the boom 26. In the illustrated embodiment, the shipper shaft 62 is rotatable about an axis defined by the shipper shaft 62 and is oriented transverse to a longitudinal axis of the boom 26. The shipper shaft 62 includes one or more pinions 66 (FIG. 2). The saddle blocks 58 are rotatably coupled to the boom 26 by the shipper shaft 62. In one embodiment, each saddle block 58 is a three-piece saddle block having two parallel side portions and a top portion extending between the side portions.

As shown in FIG. 2, the handle 30 includes a pair of parallel arms 78 and defines a first end 82 and a second end 86. The first end 82 is pivotably coupled to the bucket 34. The second end 86 is movably received in the saddle blocks 58, which is rotatable relative to the boom 26 (FIG. 1) about the shipper shaft 62. In the illustrated embodiment, the handle arms 78 are positioned on either side of the boom 26 and movably pass through each saddle block 58 such that the handle 30 is capable of rotational and translational movement relative to the boom 26. The saddle block 58 is rotatable about the shipper shaft 62 in order to rotate the handle 30 relative to the boom 26. The handle 30 is also linearly extendable relative to the saddle block 58. Each arm 78 includes a rack 96 for engaging the pinion 66 of the shipper shaft 62, forming a rack-and-pinion coupling between the handle 30 and the boom 26 (FIG. 1). Rotation of the shipper shaft 62 about its axis moves the rack 96 along the shipper shaft 62, facilitating translational movement of the handle 30 relative to the boom 26.

In the illustrated embodiment, the bucket 34 is a clamshell-type bucket 34 having a rear wall 98 and a main body 102 that can be separated from the rear wall 98 to empty the contents of the bucket 34. The main body 102 may be actuated by one or more bucket cylinders (not shown). In other embodiments, the shovel 10 may include other types of attachments, buckets, or dippers. Each pivot actuator 36 is coupled between the bucket 34 and the handle 30. The pivot actuators 36 actively control the pitch of the bucket 34 (i.e., the angle of the bucket 34 relative to the handle 30) by rotating the bucket 34 about the handle first end 82. In the illustrated embodiment, the pivot actuators 36 are hydraulic cylinders. The bucket 34 also includes teeth 106 for engaging a bank of material. The bucket 34 is used to excavate a desired work area, collect material, and transfer the collected material to a desired location (e.g., a material handling vehicle).

Figure 3:
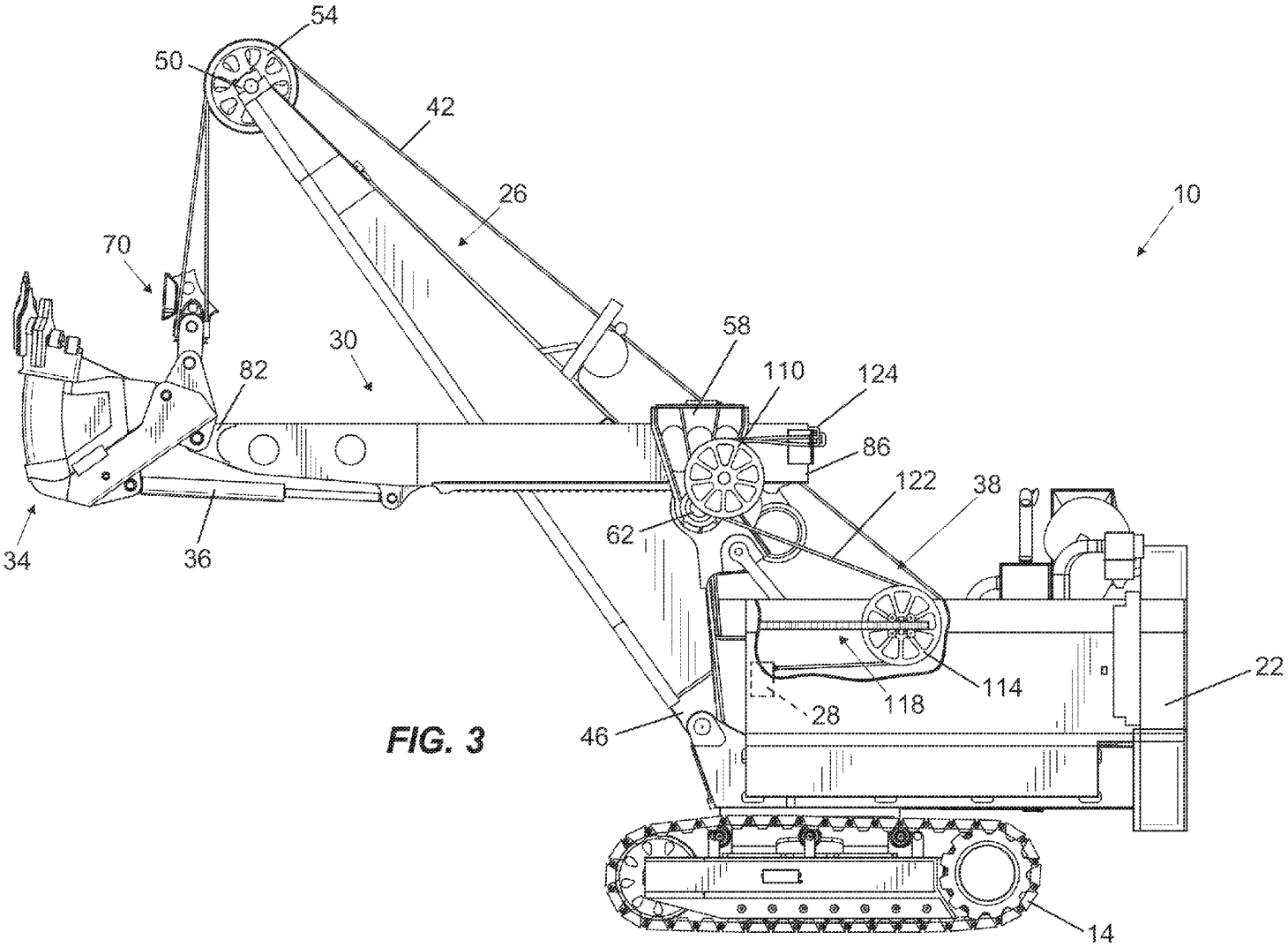
FIG. 3 is a side view of the machine of FIG. 1.
Figure 4:
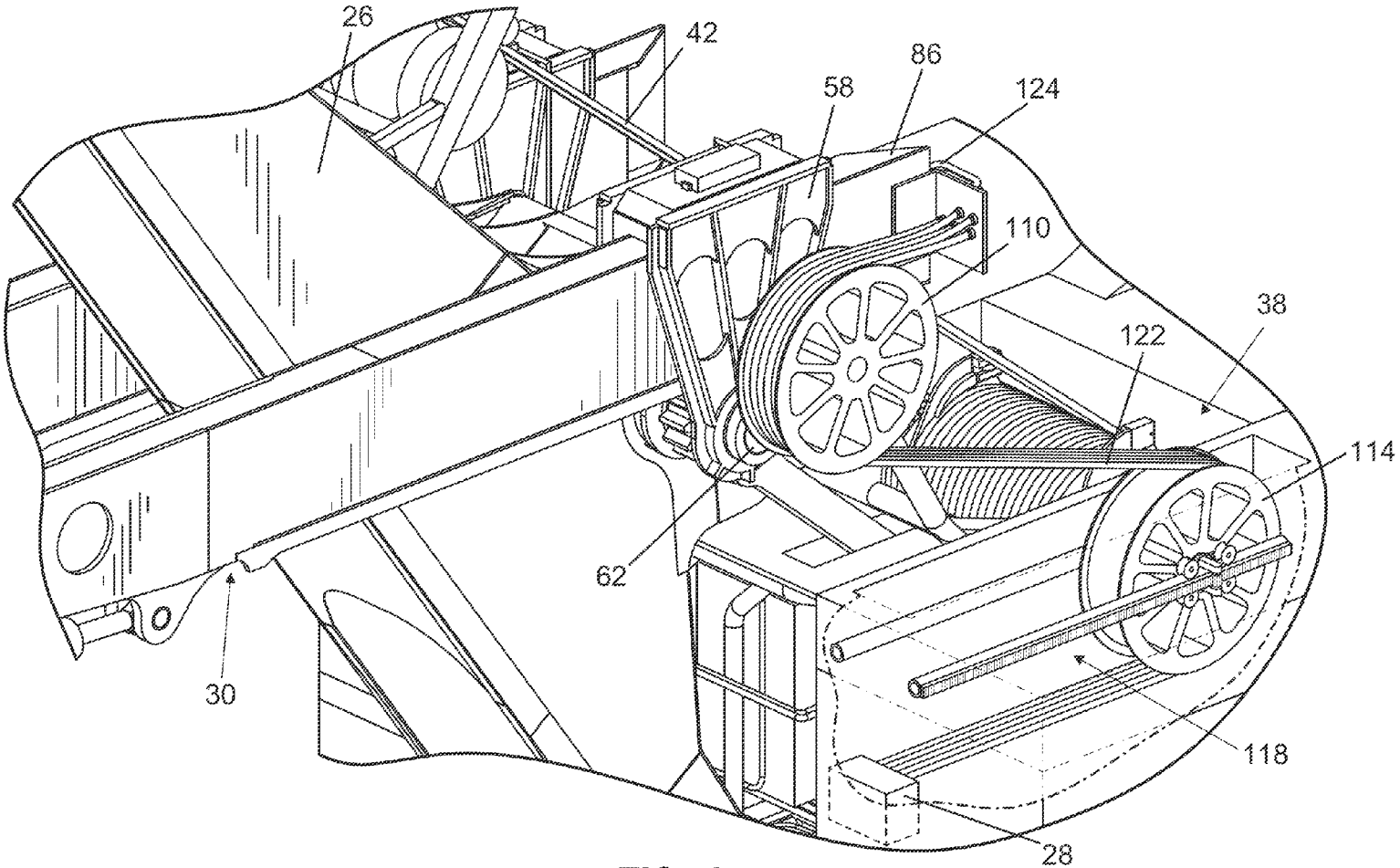
FIG. 4 is a perspective view of a conduit support system with a handle in an extended state.
Figure 5:
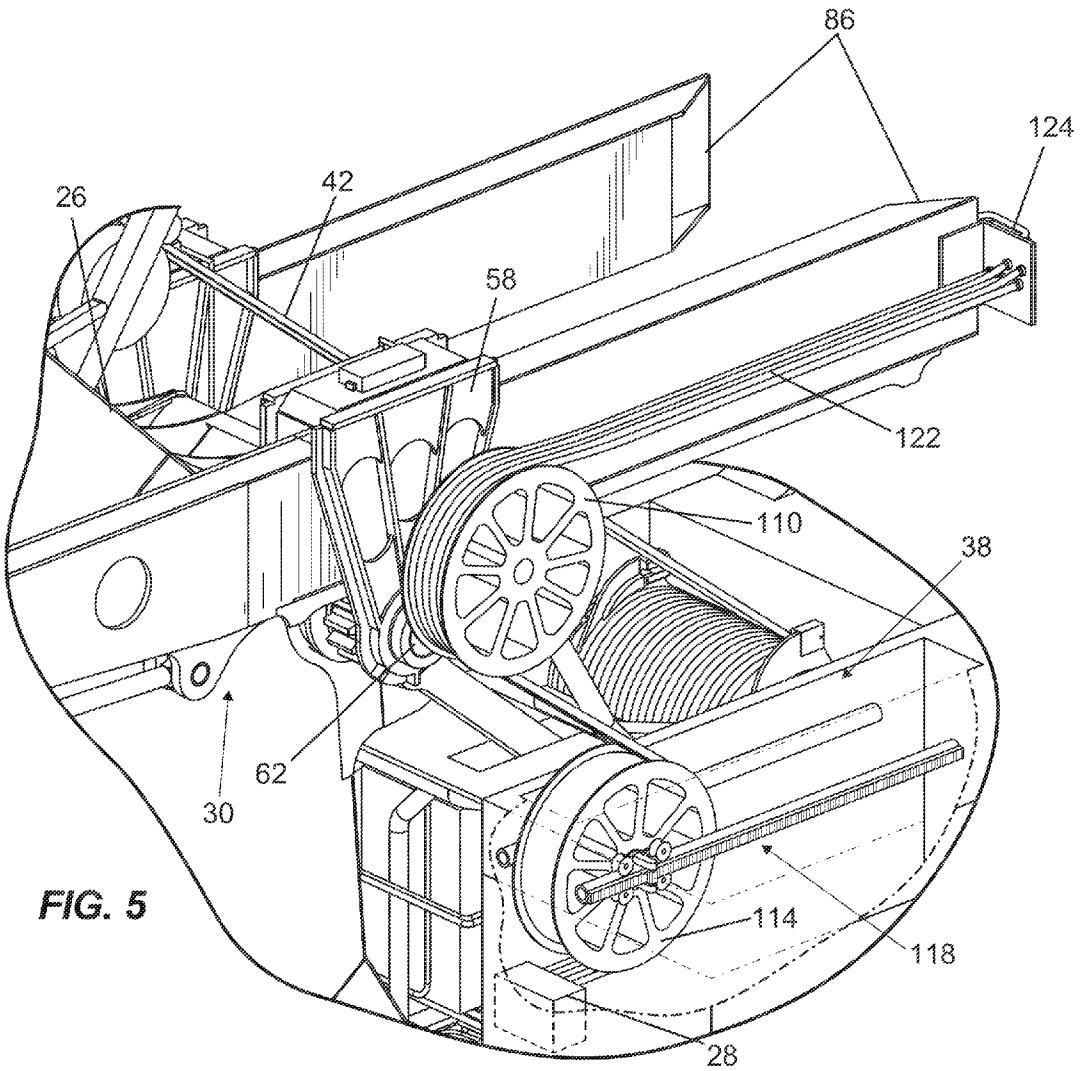
FIG. 5 is a perspective view of the conduit support system of FIG. 4 with the handle in a retracted state.

Referring to FIGS. 3-5, the conduit support system 38 includes a first member or sheave 110, a second member or sheave 114, a track 118, and conduit 122. In the illustrated embodiment, the first sheave 110 is rotatably mounted on a cantilevered shaft (not shown) coupled to the saddle block 58. In other embodiments, the first sheave 110 is coupled to the boom 26. The second sheave 114 is supported on the track 118. The conduit 122 at least partially wraps around the second sheave 114 and then at least partially wraps around the first sheave 110 in an opposite direction. The conduit 122 extends to the second end 86 of the handle 30 and is coupled to lines 124 extending along the length of the handle 30 to provide communication with the bucket 34. In one embodiment, the lines 124 are positioned along an inner surface of the handle 30. In other embodiments, the conduit 122 may be wrapped onto the sheaves 110, 114 in a different manner, or the conduit 122 may extend directly toward the attachment 34 on the first end 82 of the handle 30.

In the illustrated embodiment, the conduit 122 includes a ribbon of flexible fluid hoses in fluid communication with the fluid source 28. The conduit 122 supplies pressurized fluid from the fluid source 28 to the pivot actuators 36 and/or bucket cylinders for actuating the bucket 34. The conduit 122 may include multiple hoses to convey fluid to multiple actuators. In some embodiments, the conduit 122 provides lubricative fluid to various mechanical connections on the bucket 34 and the handle 30. The lubricative fluid may be a liquid, solid, and/or semi-solid (e.g., grease). Alternatively, the conduit 102 may include separate parallel lines to convey different types of fluid. In still other embodiments, the conduit 122 may include electrical wires or cables to provide electrical power and/or communication between the frame 22 and the attachment 34.

Figure 6:
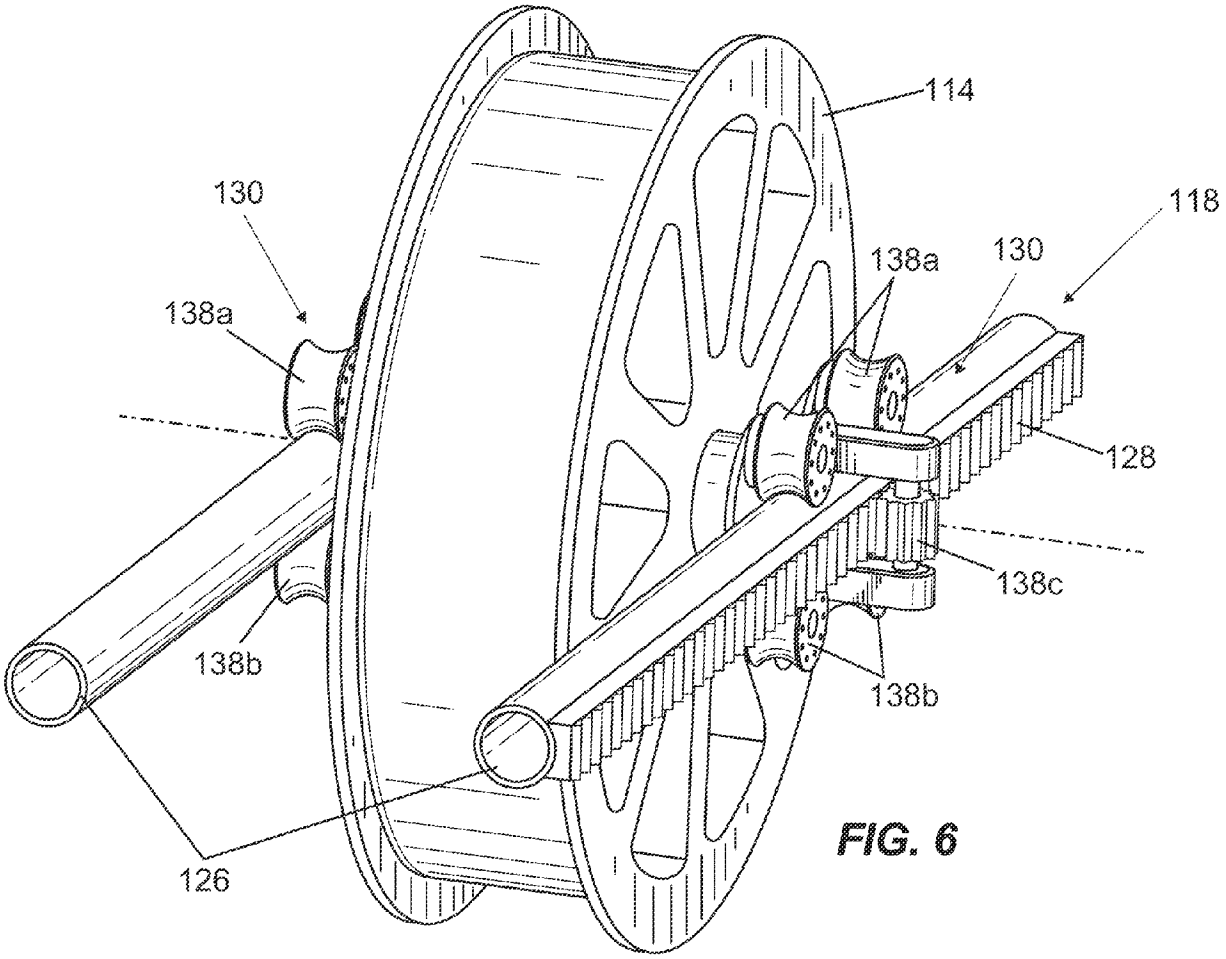
FIG. 6 is a perspective view of a second sheave and a track.

As shown in FIG. 6, the track 118 includes a pair of rails 126, and at least one of the rails 126 includes a gear surface or rack 128. The second sheave 114 is positioned between the rails 126 and is rotatably coupled to each rail 126 by a carrier assembly 130 (for example, by a shaft extending through the center of the second sheave 114). The carrier assembly 130 supports the second sheave 114 with respect to the rails 126. In the illustrated embodiment, the carrier assembly 130 includes rollers 138 that move along each rail 126 to facilitate movement of the second sheave 114 relative to the rails 126. In the illustrated embodiment, each carrier assembly 130 includes two upper rollers **138*a* engaging a first or upper edge of the rail 126 and two lower rollers 138*b* engaging a second or lower edge of the rail 126. In addition, one carrier assembly 130 includes a pinion 138*c* for engaging the rack 128. In the illustrated embodiment, the rack 128 is positioned between the upper edge and the lower edge of the rail 126 and faces outwardly from the second sheave 114. In other embodiments, both carrier assemblies 130 include a pinion 138*c***.

In the illustrated embodiment, the track 118 is orientated in a direction that is parallel to a plane of the surface on which the frame 22 is supported (i.e., the track 118 is horizontal). In other embodiments, the track 118 may be oriented in another direction such as, for example, vertical with respect to the frame 22 or on an incline or angle relative to the frame 22.

In the illustrated embodiment, the second sheave 114 is driven along the rails 126 by the pinion **138*c*. Specifically, a motor or power source (not shown) rotates the pinion 138*c*, thereby causing the pinion 138*c* and the second sheave 114 to move along the rails 126. In one embodiment, the actuation of the motor and the position of the second sheave 114 are controlled by a feedback loop including a load cell for sensing the tension in the conduit 122. The position of the second sheave 114 can be adjusted in order to maintain the tension in the conduit 122 within a predetermined range. For example, in one embodiment, the second sheave 114 is adjusted so that the tensile stress in the conduit 122 does not exceed the maximum allowable stress of various couplings positioned on the conduit 122**.

In other embodiments, the position of the second sheave 114 can be controlled in various ways. For example, the second sheave 114 may include an encoder to measure the number of rotations of the second sheave 114 so that the amount of conduit 122 that has been paid out by the second sheave 114 can be calculated. In further embodiments, a hydraulic cylinder is coupled between the second sheave 114 and the shovel frame 22, and actuation of the cylinder moves the sheave 114 along the track 118. In still other embodiments, the second sheave 114 may be moved by a chain drive system including a sheave sprocket coupled to the second sheave 114, a pair of sprockets mounted on the ends of the rails 126, and a chain wrapped around all three sprockets. As the pair of sprockets rotate, the sheave sprocket is moved relative to the rails 126.

When the user desires to position the bucket 34 to engage a bank of material, the handle 30 is extended or crowded so that the first end 82 of the handle 30 moves generally away from the frame 22 (FIG. 4). The extension of the handle 30 causes the distance between the second end 86 of the handle 30 and the first sheave 110 to decrease, thereby creating slack in the conduit 122. In response, the second sheave 114 moves along the track 118 to increase the distance between the first sheave 110 and the second sheave 114 (i.e., the second sheave 114 moves to the right in FIG. 3). The movement of the second sheave 114 takes up the slack in the conduit 122 in order to maintain a consistent tension in the conduit 122.

Similarly, as the handle 30 is retracted such that the first end 82 moves toward the frame 22 (FIG. 5), the distance between the second end 86 and the first sheave 110 increases. The second sheave 114 moves along the track 118 to decrease the distance between the first sheave 110 and the second sheave 114 (i.e., the second sheave 114 moves to the left in FIG. 3).

Thus, the second sheave 114 moves in response to the movement of the handle 30 in order to maintain a consistent state of tension in the hose 150.

The conduit support system 38 controls the motion of the conduit 120, preventing the conduit 122 from interfering with the bank or a haul vehicle, and regulates the bending and tensile loads within the conduit 122. Without the first sheave 110 and second sheave 114, the catenary sag of the conduit 122 will cause the conduit 122 to catch on obstacles in the surface mining environment and expose the conduit 122 and its connections to inconsistent or unknown loads. Such loading events reduce conduit life, thereby limiting the reliability of the components to which the conduit 122 conveys fluid or electrical power and requiring more frequent maintenance. The conduit support system 38 therefore improves the working life of the conduit 122. In the illustrated embodiment, the conduit support system 38 is positioned on one side of the boom 26; in other embodiments, a second conduit support system 38 may be positioned on the other side of the boom 26.

Figure 7:
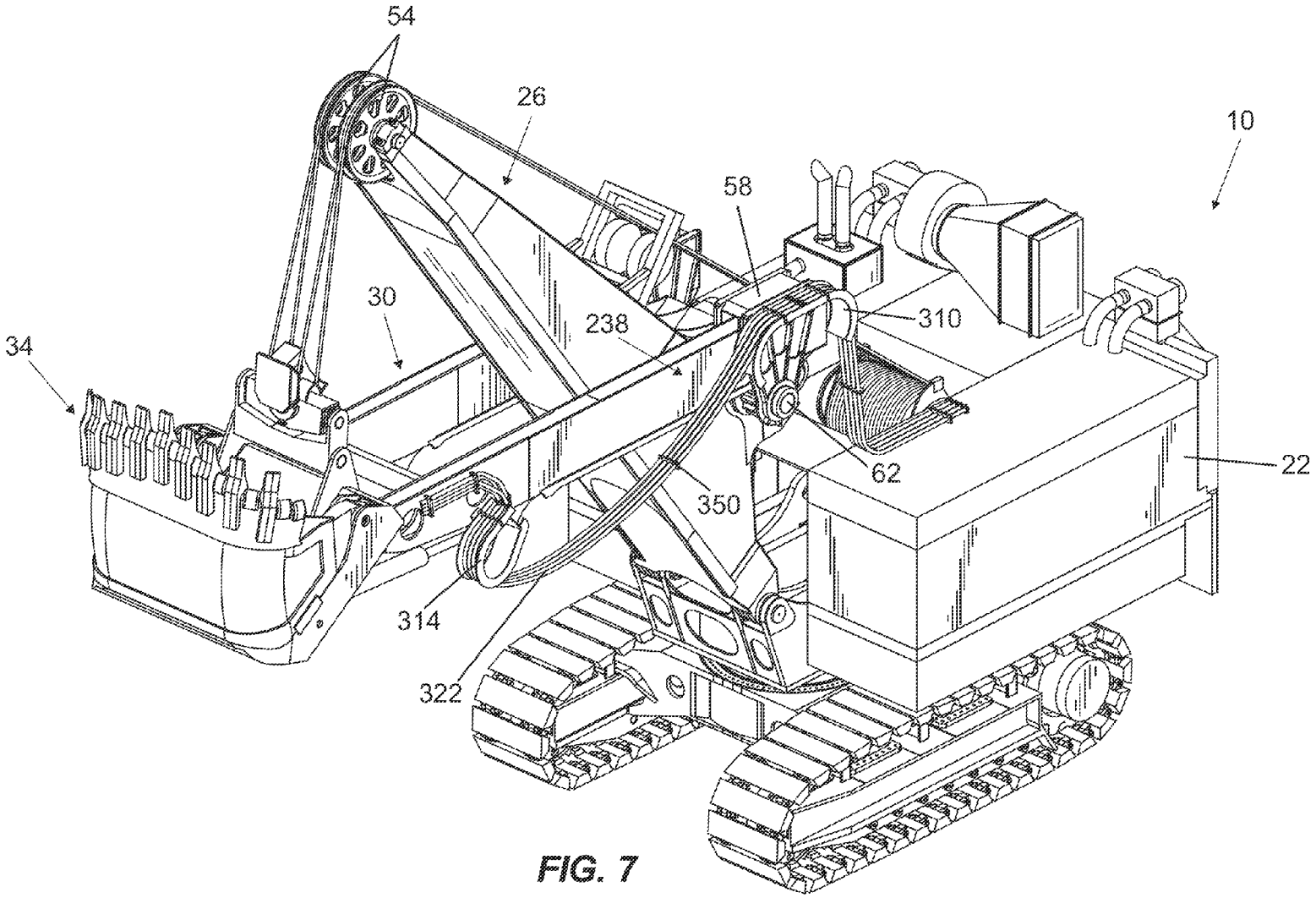
FIG. 7 is a perspective view of a mining machine according to another embodiment of the invention.

FIGS. 7-10 illustrate a conduit support system 238 according to another construction. As shown in FIG. 7, the support system 238 includes a first member or bracket 310, a second member or bracket 314, a conduit 322 (e.g., a ribbon of hydraulic conduits, grease conduits, electrical conduits, etc.) extending across the first and second brackets 310, 314, and clamp members 350 coupled to the conduit 322.

Figure 8:
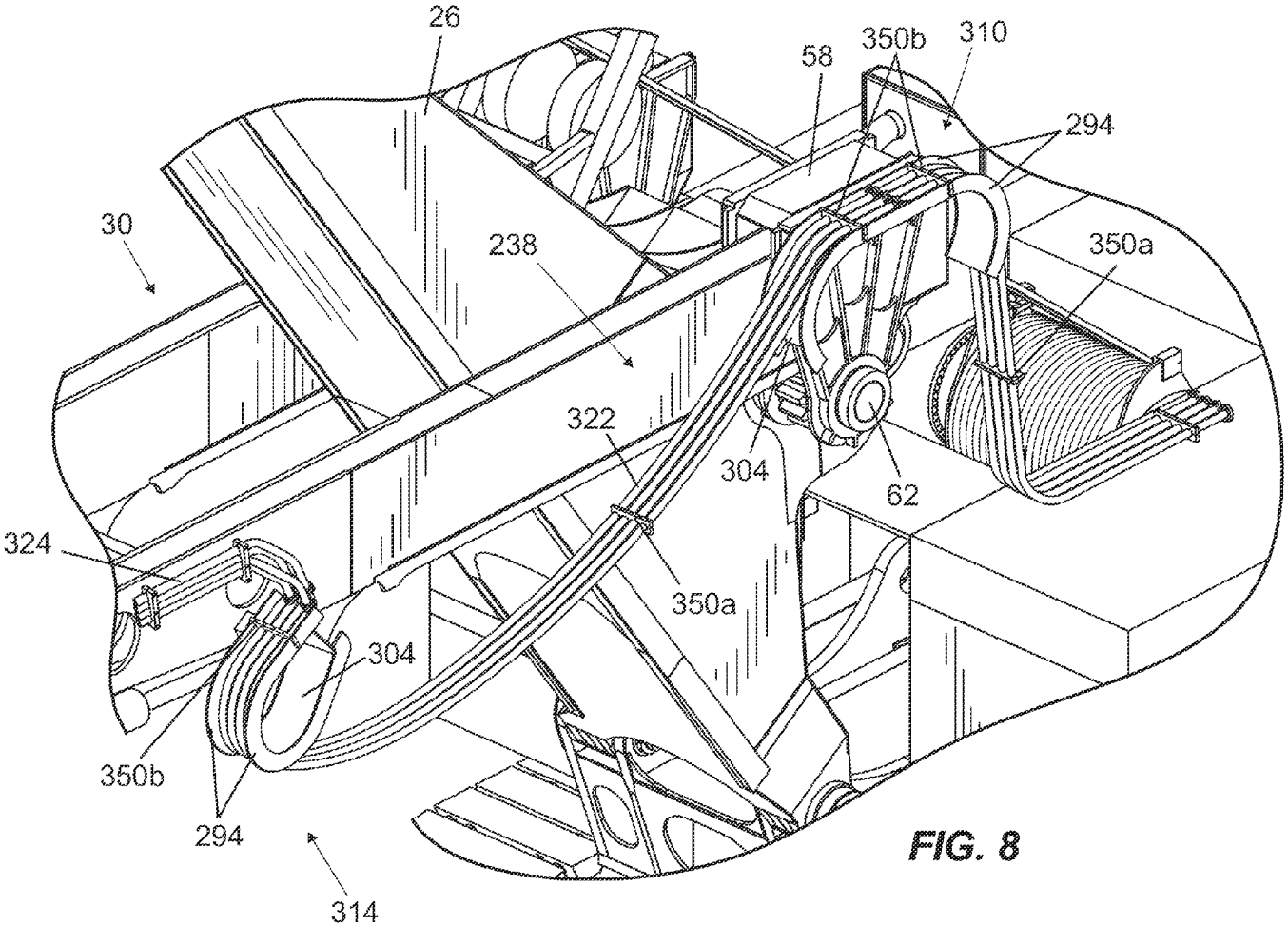
FIG. 8 is an enlarged perspective view of a conduit support system for the mining machine of FIG. 7 with a handle in an extended state.

As shown in FIG. 8, in the illustrated embodiment, each of the first and second brackets 310, 314 includes a pair of spaced apart flanges 294 and a support surface or groove 304 defined therebetween. The conduit 322 is supported within the groove 304. The first bracket 310 has a generally inverted U-shaped profile and the second bracket 314 has a generally U-shaped profile. The inverted U-shaped and U-shaped profiles of the brackets 310, 314 prevent the conduit 322 from crimping or bending. In particular, the first and second brackets 310, 314 maintain a minimum bend radius of the conduit 322 such that the conduit 322 is not damaged by crimping or bending. The minimum bend radius depends on the size and manufacturer conduit 322. In other embodiments, the brackets 310, 314 have profiles other than a U-shaped or inverted U-shaped profile (e.g., square-shaped, oval-shaped, etc.). In the illustrated construction, the first bracket 310 is coupled to (e.g., welded) the saddle block 58, and the second bracket 314 is coupled to (e.g., welded) the handle 30. In other constructions the brackets 310, 314 are located on other components of the mining shovel 10.

Figure 9:
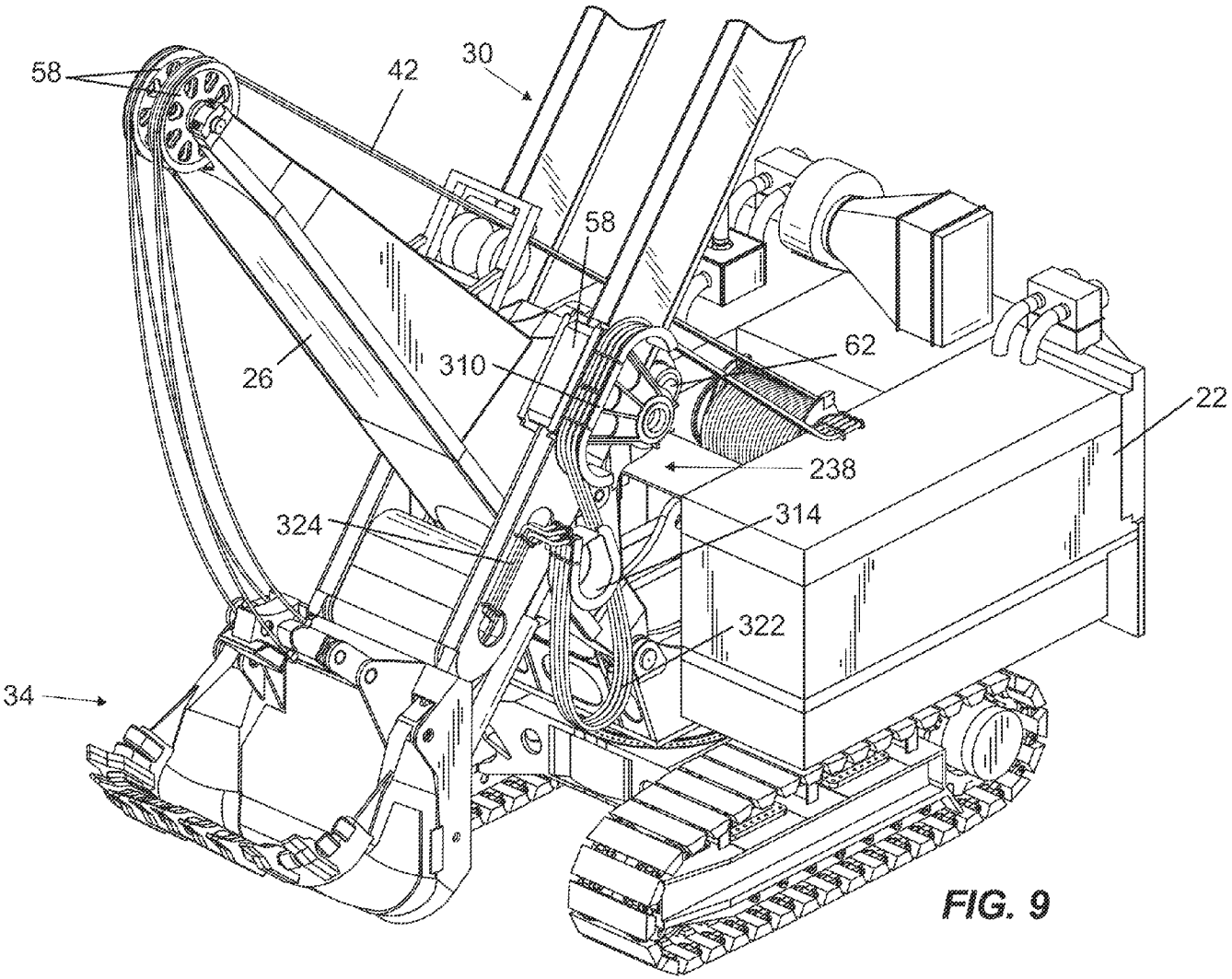
FIG. 9 is a perspective view of the mining machine of FIG. 7 with a handle in a retracted state.

As illustrated in FIGS. 8 and 9, the conduit 322 extends from the frame 22 toward the first end 82 of the handle 30 and/or various components on or adjacent the attachment 34 (e.g., a dipper door pin, bail pin, etc.). As described above, the conduit 322 may supply fluid such as hydraulic fluid or lubricant from the fluid source 28 on the frame 22 to the various components on or adjacent the attachment 34, or the conduit 322 may provide electrical communication between the frame 22 and the attachment 34. The conduit 322 extends from the frame 22, extends around a portion of the first support bracket 310 in a first direction, around a portion of the second support bracket 314 in an opposite direction, and to lines 324 that are in communication with actuators on the bucket 34. As illustrated in FIGS. 8 and 9, portions of the conduit 322 remain out of contact at all times with both the first bracket 310 and the second bracket 314.

Referring to FIGS. 8 and 9, the first bracket 310 is moveable relative to the second bracket 314 as the handle 30 moves relative to the saddle block 58 and the boom 26. The conduit 322 is moveable from a first, relaxed condition (FIGS. 9 and 10) to a second, tightened condition (FIG. 8) as the first bracket 310 moves relative to the second bracket 314. The conduit 322 engages different portions of the first and second brackets 310, 314, depending on whether the conduit 322 is in the relaxed condition or the tightened condition. In the relaxed condition, for example, a large portion of the conduit 322 hangs beneath the second bracket 314. The conduit 322 moves from the relaxed condition to the tightened condition when the handle 30 is extended relative to the boom 26, and the conduit 322 moves from the tightened condition to the relaxed condition when the handle 30 is retracted relative to the boom 26.

As best shown in FIG. 8, in the illustrated construction clamp members 350 are located along areas of the conduit 322 that are in close proximity to or in contact with the brackets 310, 314, as well as on the free hanging portions. Two clamp members **350*a* are illustrated along the free hanging portions. Two clamp members 350*b* are illustrated along the conduit 322 near the first bracket 310, and one clamp member 350*b* is illustrated along the conduit 322 near the second bracket 314. In other constructions, different numbers, locations, and configurations for the clamp member 350** are used.

Figure 10:
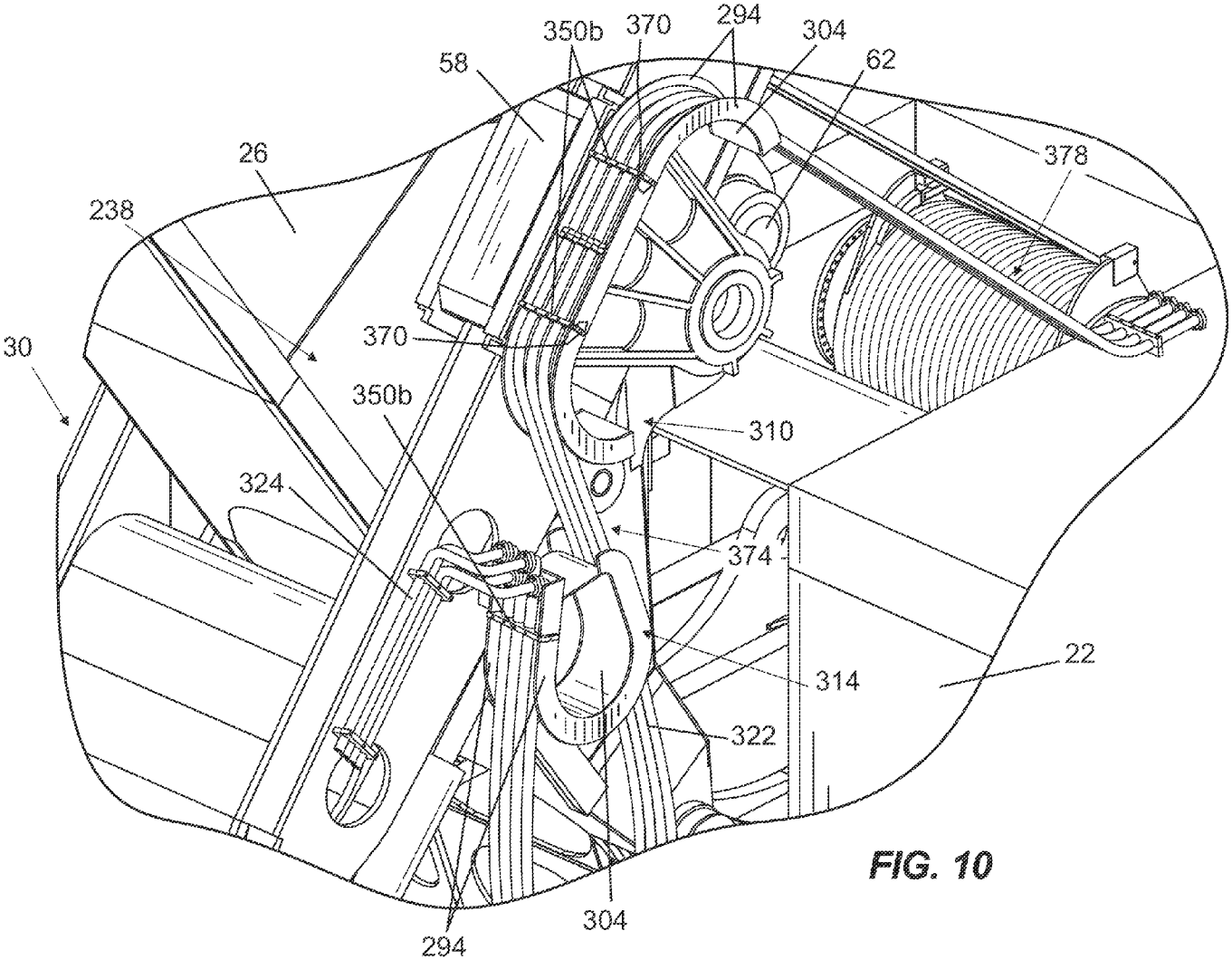
FIG. 10 is a perspective view of the conduit support system of FIG. 9.

Additionally, and as illustrated in FIG. 10, each of the clamp members **350*b* located in close proximity to or in contact with the brackets 310, 314 is positioned within slots 370 in the first and second brackets 310, 314. These clamp members 350*b* are fixedly restrained in the slots 370 and are stationary. These clamp members 350*b* serve as anchor points for the conduit 322. On the first bracket 310, the clamp members 350*b* divide the conduit 322 generally into a forward conduit portion 374 proximate the first end 82 (FIG. 9) of the handle 30 and a rear conduit portion 378 proximate the frame 22. Similarly, on the second bracket 314, the clamp member 350*b* divides the conduit 322 between a portion coupled to the lines 324 and the forward conduit portion 374. The clamp members 350 in close proximity to or in contact with the brackets 310, 314 restrain movement of portions of the conduit 322**.

Figure 11:
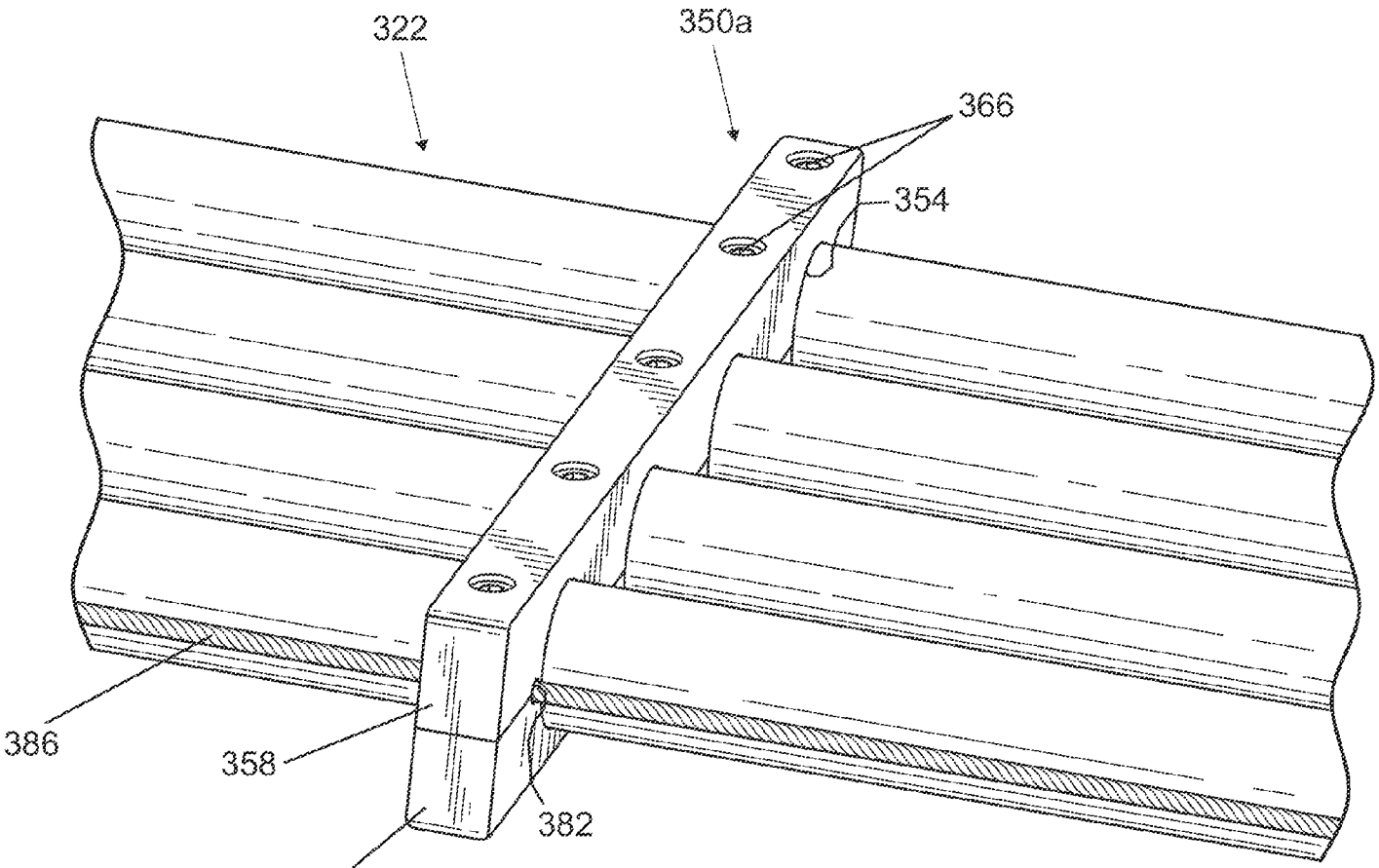
FIG. 11 is a perspective view of a clamping member and a portion of a conduit.

Referring to FIG. 11, each clamp member 350 includes openings 354, and the conduit 322 extends through the openings 354. Some clamp members **350*a* (FIG. 8) are located along the free hanging portions of the conduit 322 (i.e., the portions not adjacent the brackets 310, 314), and include openings 354 with diameters larger than a diameter of the lines of the conduit 322, so that the lines of the conduit ribbon 322 are allowed to expand and contract naturally due to fluid pressure in the conduit 322 in these regions. Each of the clamp members 350 includes a first portion 358 and a second portion 362 releasably coupled to the first portion 358 with fasteners 366 that extend through the first and second portions 358, 362. The clamping force prevents the conduit 322 from sliding through the openings 354**.

With reference to FIGS. 8 and 11, the clamp members **350*a* on the free hanging portions of the conduit 322 prevent the lines of the conduit ribbon 322 from contacting and rubbing against one another, particularly during movement of the conduit 322 from the relaxed condition to the tightened condition, and vice versa. As shown in FIG. 11, the clamp members 350*a* include additional openings 382 supporting one or more cables 386 extending alongside the conduit 322. The openings 382 have a diameter that is sized small enough such that when the first and second portions 358, 362 are coupled together, both portions 358, 362 press against the cable 386. The cable 386 is made from a material having a high tensile strength (e.g., steel) and absorbs substantially all or any tension that develops during movement of the free hanging portions of the conduit 322. In one embodiment, the conduit is controlled such that the tensile stress does not exceed 50% of the yield stress of the cable 386**.

Although shown with respect to the embodiment of FIGS. 7-11, the cable 386 could also be incorporated into the embodiment of FIGS. 1-6. In one embodiment, the position of the sheave 114 would be controlled to maintain the tensile stress in the conduit 112 below approximately 50% of the yield stress of the cable 386.

Thus, the invention provides, among other things, a conduit support system for an industrial machine. Although the invention has been described in detail with reference to certain preferred embodiments, variations and modifications exist within the scope and spirit of one or more independent aspects of the invention as described. Various features and advantages of the invention are set forth in the following claims.

What is claimed is:

1. An industrial machine comprising:

a frame supporting a boom having a first end and a second end opposite the first end;

an arm movably coupled to the boom and including a first end and a second end;

an attachment coupled to the first end of the arm;

a conduit extending from the frame to a position adjacent the attachment;

a first member coupled to the boom, the first member supporting a first portion of the conduit as the arm moves relative to the boom; and a second member spaced apart from the first member and supporting a second portion of the conduit as the arm moves relative to the boom, the second member movable relative to the first member, the second member including a surface having a U-shaped profile and the second portion of the conduit wrapping around at least a portion of the U-shaped profile, wherein the conduit is wrapped over the first member in a first direction and is wrapped over the second member in a second direction opposite the first direction.

2. The industrial machine of claim 1, wherein the frame includes a saddle block pivotably coupled to the boom and supporting the arm for movement relative to the boom, wherein the first member is coupled to the saddle block.

3. The industrial machine of claim 1, wherein translational movement of the arm relative to the boom causes the second member to move relative to the first member.

4. The industrial machine of claim 3, wherein the second member is coupled to the arm.

5. The industrial machine of claim 1, wherein the first member is a first bracket having a generally U-shaped profile and the second member is a second bracket.

6. The industrial machine of claim 5, wherein one of the first bracket and the second bracket is inverted with respect to the other of the first bracket and the second bracket.

7. The industrial machine of claim 5, wherein the curvature of the first bracket corresponds to a first minimum bend radius of the conduit and the curvature of the second bracket corresponds to a second minimum bend radius of the conduit.

8. The industrial machine of claim 1, wherein the frame includes a fluid source, wherein the attachment includes a bucket coupled to the first end of the arm and an actuator for actuating the bucket, wherein the conduit provides fluid communication between the fluid source and the actuator.

9. The industrial machine of claim 1, wherein the attachment is a bucket supported by a hoist cable extending over an end of the boom.

10. The industrial machine of claim 1, wherein the conduit includes a ribbon having multiple lines, and further comprising a clamp member including openings through which the lines pass, the clamp member maintaining a minimum spacing between the lines.

11. The industrial machine of claim 1, further comprising a cable extending parallel to the conduit, the cable resisting a tension force exerted on the conduit.

12. The industrial machine of claim 1, wherein a portion of the conduit remains out of contact with the first member and the second member at all times.

13. The industrial machine of claim 1, wherein contact between the conduit and the second member changes as the arm moves relative to the boom.

14. A conduit support system for an industrial machine, the industrial machine having a frame supporting a boom including a saddle block, an arm having a first end and a second end and supported by the saddle block for movement relative to the boom, and an attachment coupled to the second end of the arm, the conduit support system comprising:

a conduit for providing at least one of fluid communication and electrical communication between a source supported on the frame and the second end of the arm;

a first member supporting a first portion of the conduit, the first member configured to be secured to the saddle block; and a second member spaced apart from the first member, the second member movable relative to the first member due to movement of the arm relative to the boom, the second member supporting a second portion of the conduit, the second member including a surface having a U-shaped profile and the second portion of the conduit wrapping around at least a portion of the U-shaped profile, wherein the conduit is wrapped over the first member in a first direction and is wrapped over the second member in a second direction opposite the first direction.

15. The conduit support system of claim 14, wherein the first member is a first bracket having a generally U-shaped profile and the second member is a second bracket, wherein one of the first bracket and the second bracket is inverted.

16. The conduit support system of claim 15, wherein the curvature of the first bracket corresponds to a first minimum bend radius of the conduit and the curvature of the second bracket corresponds to a second minimum bend radius of the conduit.

17. The conduit support system of claim 14, wherein the conduit provides fluid communication between a fluid source and an actuator for the attachment.

18. The conduit support system of claim 14, wherein the conduit includes a ribbon having multiple lines, and further comprising a clamp member including openings through which the lines pass, the clamp member maintaining a minimum spacing between the lines.

19. The conduit support system of claim 14, further comprising a cable extending parallel to the conduit, the cable resisting a tension force exerted on the conduit.

20. The industrial machine of claim 1, wherein the arm is movable between a retracted position and an extended position, wherein the second member is positioned proximate the first member when the arm is in the retracted position and the second member is positioned away from the first member when the arm is in the extended position.

21. The industrial machine of claim 1, wherein a third portion of the conduit extends between the first portion of the conduit and the second portion of the conduit, wherein the third portion is in a slack condition when the arm is retracted relative to the boom.

22. The industrial machine of claim 1, wherein the second member is rigidly secured to the arm and positioned between the first member and the attachment.

23. The industrial machine of claim 2, wherein the first member is secured to the saddle block such that the first member does not move relative to the saddle block.

24. The industrial machine of claim 7, wherein the first minimum bend radius is equal to the second minimum bend radius.

25. The conduit support system of claim 14, wherein the second member is positioned proximate the first member when the arm is in the retracted position and the second member is positioned away from the first member when the arm is in the extended position.

26. The conduit support system of claim 14, wherein the first portion is secured to the first member and the second portion is secured to the second member, wherein a third portion of the conduit is positioned between the first portion and the second portion, wherein the third portion is in a slack condition when the arm is retracted relative to the boom.

27. The conduit support system of claim 16, wherein the first minimum bend radius is equal to the second minimum bend radius.

* * * * *